US011028843B2

(12) United States Patent
Jung et al.

(10) Patent No.: US 11,028,843 B2
(45) Date of Patent: Jun. 8, 2021

(54) SYSTEM AND METHOD FOR CONTROLLING DUAL OIL PUMP

(71) Applicants: HYUNDAI MOTOR COMPANY, Seoul (KR); KIA MOTORS CORPORATION, Seoul (KR)

(72) Inventors: Byunghwan Jung, Gwangmyeong-si (KR); Jin Hoon Kim, Ansan-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/745,077

(22) Filed: Jan. 16, 2020

(65) Prior Publication Data

US 2021/0062804 A1 Mar. 4, 2021

(30) Foreign Application Priority Data

Aug. 27, 2019 (KR) ..... 10-2019-0105404

(51) Int. Cl.

| | |
|---|---|
| ***F04B 49/08*** | (2006.01) |
| ***F04B 9/02*** | (2006.01) |
| ***F04B 53/18*** | (2006.01) |
| ***F04B 17/03*** | (2006.01) |

(52) U.S. Cl.

CPC ..... *F04B 49/08* (2013.01); *F04B 9/02* (2013.01); *F04B 17/03* (2013.01); *F04B 53/18* (2013.01)

(58) Field of Classification Search

CPC .. F04B 9/02; F04B 17/03; F04B 49/08; F04B 53/18

See application file for complete search history.

(56) References Cited

U.S. PATENT DOCUMENTS

| | | | | |
|---|---|---|---|---|
| 7,481,053 | B2 * | 1/2009 | Kitano | F16H 61/0031 60/428 |
| 7,946,389 | B2 * | 5/2011 | Kakinami | F16H 57/04 184/27.2 |
| 8,371,823 | B2 * | 2/2013 | Lee | F04B 49/06 417/44.1 |
| 9,108,499 | B2 * | 8/2015 | Long | F16H 61/0025 |
| 9,127,667 | B2 * | 9/2015 | Lee | F04B 17/03 |
| 9,689,773 | B2 * | 6/2017 | Kim | F01M 1/02 |

* cited by examiner

*Primary Examiner* — Patrick Hamo
(74) *Attorney, Agent, or Firm* — Brinks Gilson & Lione

(57) ABSTRACT

A system for controlling a dual oil pump of an engine includes: an oil pan to store engine oil, a battery, an electric oil pump (EOP) for discharging the engine oil from the oil pan using a motor driven with electric power supplied from the battery, a mechanical oil pump (MOP) connected to a crankshaft of the engine and discharging the engine oil using the mechanical driving force of the engine, an oil gallery for circulating the engine oil discharged by the EOP and the MOP to each part of the engine, a transmission passage for delivering the engine oil discharged from the EOP and the MOP to the oil gallery, a data detector for detecting engine data for the control of the EOP, and a controller for controlling the EOP.

13 Claims, 6 Drawing Sheets

FIG. 1 "PRIOR ART"

SYSTEM AND METHOD FOR CONTROLLING DUAL OIL PUMP

CROSS-REFERENCE TO RELATED APPLICATION

This application claims priority to and the benefit of Korean Patent Application No. 10-2019-0105404, filed on Aug. 27, 2019, the entire contents of which are incorporated herein by reference.

FIELD

The present disclosure relates to a system and method for controlling dual oil pump. More particularly, the present disclosure relates to a system and method for controlling dual oil pump for controlling a mechanical oil pump and an electric oil pump of an engine together.

BACKGROUND

The statements in this section merely provide background information related to the present disclosure and may not constitute prior art.

In general, an internal combustion engine of a vehicle is a power engine in which air and fuel is mixed and combusted in a combustion chamber so that the engine is operated by energy generated from the combustion. As the internal combustion engine, a multi-cylinder engine having a plurality of cylinders is mainly used to increase the output of the engine and to reduce noise and vibration.

Each part of the multi-cylinder engine is operated at a high speed in a high temperature environment, and engine oil is used for lubrication, cooling, and driving of the parts of the engine. The engine oil that has passed through each of the parts is filtered through a filter and supplied to the parts through an oil gallery, which is a circulation passage of the engine oil. An oil pump is provided for the circulation of the engine oil.

A mechanical oil pump (MOP) pumps engine oil using the mechanical driving force of the engine, and the electric oil pump (EOP) pumps the engine oil using the driving force of the motor.

FIG. 1 is a diagram illustrating a conventional system for controlling dual oil pump for a transmission and its problems.

Referring to FIG. 1, the conventional system for controlling dual oil pump for a transmission is provided with a mechanical oil pump (MOP) and an electric oil pump (Electric Oil Pump, EOP), and the engine oil pumped through the mechanical oil pump or the electric oil pump is supplied to each part of the transmission via a pressure-forming valve.

In general, since the mechanical oil pump is configured for high pressure and the electric oil pump is configured for low pressure, when the discharge port of the mechanical oil pump and the discharge port of the electric oil pump are directly connected, the oil may flow back to the electric oil pump by the pressure of the mechanical oil pump.

In order to prevent such oil backflow, a check valve or a corresponding mechanism is provided on the outlet of the electric oil pump. In addition, since the electric oil pump performs only the discharge role of the engine oil due to the check valve, etc., an additional flow control system is additionally provided for controlling the total oil flow rate.

Such a conventional technology has a problem in that the design cost and production cost increase and the engine structure becomes complicated.

The above information disclosed in this Background section is only for enhancement of understanding of the background of the present disclosure and therefore it may contain information that does not form the prior art that is already known to a person of ordinary skill in the art.

SUMMARY

The present disclosure provides a system and method for controlling dual oil pump for an engine provided with a mechanical oil pump and an electric oil pump to generate a regenerative energy by using the oil supercharged to the electric oil pump by removing the separate parts such as the check valve in the conventional dual oil pump structure.

In one form of the present disclosure, a system for controlling dual oil pump to control dual oil pump structure of an engine includes: an oil pan to store engine oil; a battery; an electric oil pump (EOP) for discharging the engine oil from the oil pan using the driving force of a motor driven with electric power supplied from the battery; a mechanical oil pump (MOP) connected to a crankshaft of the engine and discharging the engine oil from the oil pan using a mechanical driving force of the engine; an oil gallery for circulating the engine oil discharged by the electric oil pump and the mechanical oil pump to each part of the engine; a transmission passage for delivering the engine oil discharged from the electric oil pump and the mechanical oil pump to the oil gallery, and including an electric oil pump outlet connected to the electric oil pump and a mechanical oil pump outlet connected to the mechanical oil pump; a data detector for detecting engine data to control the electric oil pump; and a controller for controlling the operation of the electric oil pump. In particular, the data detector includes an oil pressure sensor for detecting oil pressure of the oil gallery, and an RPM sensor for detecting revolutions per minute (RPM) of the engine, and the electric oil pump outlet and the mechanical oil pump outlet of the transmission passage are directly connected to each other. In one form, the controller is configured to determine a target oil pressure of the oil gallery based on the engine data detected through the data detector, and to rotate the electric oil pump either in a forward direction or in a reverse direction, or stop according to the target oil pressure.

The controller may control the rotation speed and increase a torque of the electric oil pump when the detected oil pressure is less than the target oil pressure.

The controller may generate a stop torque to the electric oil pump when the detected oil pressure is equal to the target oil pressure, and control the electric oil pump not to rotate by rotating the electric oil pump in the forward direction to discharge the engine oil of the oil pan or by flowing the engine oil back from the mechanical oil pump outlet to the electric oil pump.

The controller may reduce or dissipate the torque of the electric oil pump when the detected oil pressure is greater than the target oil pressure, and control the electric oil pump to reversely rotate by allowing the engine oil to flow from the mechanical oil pump outlet to the electric oil pump end side by the pressure difference generated thereby.

The battery may be charged by transferring power generated by the reverse rotation of the electric oil pump to the battery.

The controller may determine an electric oil pump driving region when the detected RPM is smaller than the first set RPM and determine the target oil pressure to be a first set oil pressure. The controller may determine a mechanical oil pump driving region when the detected RPM is greater than or equal to the first set RPM and less than the second set RPM value and determine. the target oil pressure to be in proportion to the detected RPM In addition, the controller may determine a regenerative braking region when the detected RPM is greater than or equal to a second set RPM, and determine the target oil pressure to be a second set oil pressure.

The controller may include: an electric oil pump controller for controlling the power supplied to the electric oil pump to control the torque of the electric oil pump and the discharge amount of the engine oil discharged by the electric oil pump; and an electronic control unit of the vehicle to control the electric oil pump controller.

In another form of the present disclosure, a method for controlling a dual oil pump of a system is provided. In particular, the system includes: the dual oil pump having an electric oil pump (EOP) and a mechanical oil pump (MOP), an oil gallery, a transmission passage for delivering the engine oil discharged from the electric oil pump and the mechanical oil pump to the oil gallery and including an electric oil pump outlet connected to the electric oil pump and a mechanical oil pump outlet connected to the mechanical oil pump, a data detector for detecting engine data including at least an oil pressure or revolutions per minute (RPM) of an engine, and a controller for controlling the operation of the electric oil pump by controlling power supplied to the electric oil pump. The method for controlling the dual oil pump of the system includes: driving the electric oil pump by the controller; detecting the engine data by the data detector; determining, by the controller, a target oil pressure based on the detected engine data; comparing, by the controller, the detected oil pressure with the target oil pressure; and controlling, by the controller, a torque of the electric oil pump such that the electric oil pump rotates in a forward or reverse direction, or stops according to a comparison result of the target oil pressure and the detected oil pressure.

In controlling the torque of the electric oil pump, the torque of the electric oil pump may be controlled to increase when the detected oil pressure is less than the target oil pressure.

In controlling the torque of the electric oil pump, a stop torque to the electric oil pump may be generated when the detected oil pressure is equal to the target oil pressure, and the electric oil pump may be controlled not to rotate by rotating the electric oil pump in the forward direction to discharge the engine oil of the oil pan or by flowing the engine oil back from the mechanical oil pump outlet to the electric oil pump.

In controlling the torque of the electric oil pump, the torque of the electric oil pump may be reduced or dissipated if the detected oil pressure is greater than the target oil pressure, and the electric oil pump may be controlled to rotate in the reverse direction by allowing the engine oil to flow from the mechanical oil pump outlet to the electric oil pump outlet by a pressure difference generated thereby.

In one form, controlling the torque of the electric oil pump may include charging a battery by transferring power generated by the reverse rotation of the electric oil pump to the battery.

In determining a target oil pressure, when the detected RPM is smaller than the first set RPM, it may be determined to be an electric oil pump driving region and the target oil pressure is determined to be a first set oil pressure. When the detected RPM is greater than or equal to the first set RPM and less than the second set RPM value, it may be determined to be a mechanical oil pump driving region and the target oil pressure is determined to be in proportion to the detected RPM. In another form, when the detected RPM is greater than or equal to the second set RPM, it may be determined to be a regenerative braking region and the target oil pressure is determined to be a second set oil pressure.

As described above, according to an exemplary form of the present disclosure, by removing the separate parts such as the check valve in the dual oil pump structure, a regenerative energy may be generated by using the oil supercharged to the electric oil pump.

Further, according to an exemplary form of the present disclosure, by removing the separate parts such as the check valve in the dual oil pump structure, it is possible to simplify the engine structure and reduce the engine driving loss and frictional loss.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
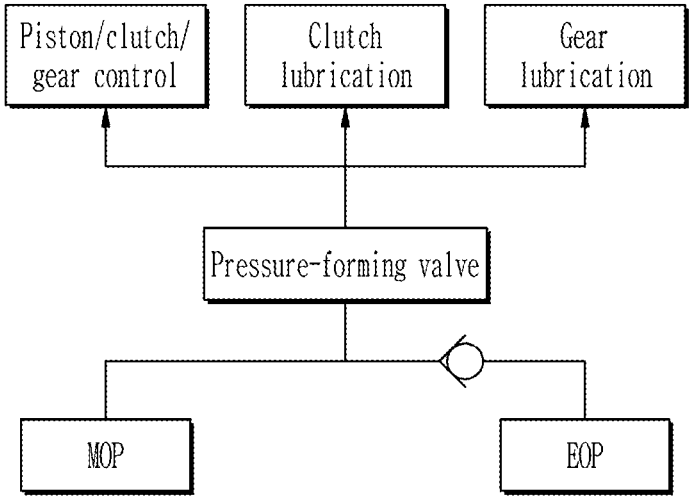
FIG. 1 is a diagram illustrating a conventional system for controlling a dual oil pump for a transmission.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As those skilled in the art would realize, the described forms may be modified in various different ways, all without departing from the spirit or scope of the present disclosure.

The size and thickness of each component shown in the drawings are arbitrarily shown for understanding and ease of description, but the present disclosure is not limited thereto, and the thickness of parts, regions, etc., are exaggerated for clarity.

Further, in the following detailed description, names of constituents, which are in the same relationship, are divided into "the first", "the second", and the like, but the present disclosure is not limited to the order in the following description.

In the specification, unless explicitly described to the contrary, the word "comprise" and variations such as "comprises" or "comprising", will be understood to imply the inclusion of stated elements but not the exclusion of any other elements.

In addition, the terminology such as " . . . unit", " . . . means", " . . . part", or " . . . member", which is disclosed in the specification, refers to a unit of an inclusive constituent which performs at least one of the functions or operations.

Figure 2:
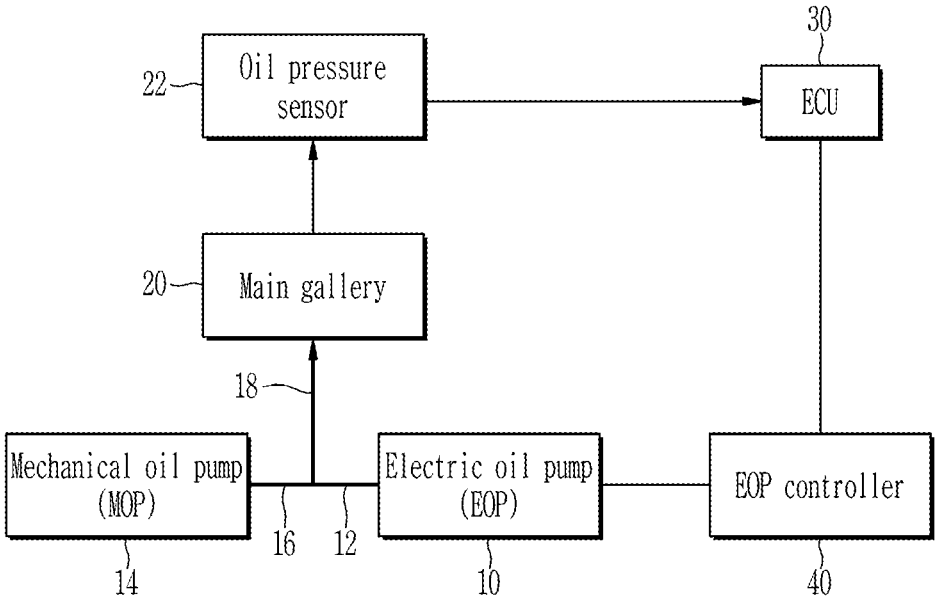
FIG. 2 is a block diagram illustrating a system for controlling a dual oil pump according to one form of the present disclosure.

FIG. 2 is a block diagram illustrating a system for controlling a dual oil pump according to one form of the present disclosure.

Referring to FIG. 2, A system for controlling dual oil pump includes: an electric oil pump (EOP) 10, a mechanical oil pump (MOP) 14, a transmission passage 18, an oil gallery 20, an oil pressure sensor 22, and a controller (not shown).

The electric oil pump 10 and the mechanical oil pump 14 discharge oil from the oil pan containing the engine oil of the vehicle by using the driving force of the motor and the mechanical driving force, respectively.

The electric oil pump 10 includes a motor driven therein with electric power supplied from a battery of the vehicle, and discharges engine oil from the oil pan by using the driving force of the motor.

The mechanical oil pump 14 is connected to the crankshaft of the engine and discharges the engine oil from the oil pan by using a mechanical driving force transmitted according to the driving of the engine.

In general, a mechanical oil pump may be driven at a relatively high pressure compared to an electric oil pump by receiving a mechanical driving force of an engine. Therefore, in the dual oil pump structure in which the mechanical oil pump and the electric oil pump are provided at the same time, the mechanical oil pump is mainly used for high pressure, and the electric oil pump is used for low pressure.

In an exemplary form of the present disclosure, the electric oil pump 10 is operated in a relatively low pressure region, and the mechanical oil pump 14 is driven in a relatively high pressure region.

The oil gallery 20 is also referred to as a main gallery, and serves as a main circulation path in which engine oil is supplied and circulated to each part of the engine. That is, the engine oil discharged from the electric oil pump 10 and the mechanical oil pump 14 is transferred and circulated through the oil gallery 20 to each part of the engine.

The engine oil discharged from the electric oil pump 10 and the mechanical oil pump 14 is transferred to the oil gallery 20 through a transmission passage 18. For this purpose, the transmission passage 18 includes an electric oil pump outlet 12 connected to the electric oil pump 10 and a mechanical oil pump outlet 16 connected to the mechanical oil pump 14.

The mechanical oil pump outlet 16 and the electric oil pump outlet 12 are configured to be directly connected to each other to allow mutual flow.

As described above, a mechanical oil pump may be driven at a high pressure as compared with a conventional electric oil pump. Accordingly, when the discharge port of the mechanical oil pump and the discharge port of the electric oil pump are directly connected, the oil may flow back to the electric oil pump by the pressure of the mechanical oil pump.

Conventionally, in order to prevent such oil backflow, a check valve or a corresponding mechanism is provided on the outlet of the electric oil pump. In addition, since the electric oil pump performs only the discharge role of the engine oil due to the check valve, etc., a separate flow control system is provided for controlling the total oil flow rate. Such a conventional technology has a problem in that the design cost and production cost increase and the engine structure becomes complicated.

In contrast, in an exemplary form of the present disclosure, the check valve as described above is not provided at the electric oil pump outlet 12. Accordingly, when the discharge pressure of the mechanical oil pump 14 is higher than the discharge pressure of the electric oil pump 10, the engine oil may be flowed back to the electric oil pump outlet 12 according to the pressure difference, and the electric oil pump 10 may be reversely rotated.

Here, as described above, the electric oil pump 10 includes a motor to obtain a driving force. When the electric power is supplied to the motor, the motor rotates in the forward direction and the driving force is provided, and when the motor rotates by the external force, the counter electromotive force is generated according to the reverse rotation. The phenomenon in which the kinetic energy is converted into electrical energy as the motor rotates by the kinetic energy supplied from the outside is called regenerative braking.

That is, in an exemplary form of the present disclosure, the mechanical oil pump outlet 16 and the electric oil pump outlet 12 are directly connected to each other to allow mutual flow, and parts such as a conventional check valve which prevents the engine oil from flowing into the electric oil pump outlet 12 from the mechanical oil pump outlet 16 have been deleted. Accordingly, in a situation where the discharge pressure of the mechanical oil pump 14 is higher than the discharge pressure of the electric oil pump 10, the engine oil is flowed back to the electric oil pump outlet 12 according to the pressure difference so that the electric oil is discharged. The pump 10 may be reversely rotated, and power is generated according to the regenerative braking phenomenon.

The electric power generated through the electric oil pump 10 is transferred to the battery of the vehicle and used to charge the battery. Through such an energy recovery method, it is possible to improve fuel efficiency of the vehicle.

Meanwhile, in an exemplary form of the present disclosure, without the separate flow control system in the conventional technology as described above, the flow rate of the entire engine oil flowing into the oil gallery 20 may be controlled only through the motor rotation control of the electric oil pump 10. More specifically, when the engine oil discharge pressure or discharge amount by the mechanical oil pump 14 is less than the target value, the torque of the electric oil pump 10 is increased in the forward direction to increase the total discharge pressure or discharge amount of the engine oil. In contrast, when the engine oil discharge pressure or discharge amount by the mechanical oil pump 14 exceeds a target value, the torque of the electric oil pump 10 is reduced or dissipated. Accordingly, engine oil is introduced from the mechanical oil pump outlet 16 into the electric oil pump outlet 12 to reduce the total discharge pressure or discharge amount of the engine oil. At this time, regenerative braking occurs in the electric oil pump 10 to charge the battery.

The oil pressure sensor 22 detects the oil pressure inside the oil gallery 20.

The controller (not shown) is configured to control the driving of the electric oil pump, and includes an electronic control unit 30 and an electric oil pump controller 40.

The electronic control unit (ECU) 30 performs calculation and control for controlling the system for controlling the dual oil pump according to an exemplary form of the present disclosure.

The electronic control unit 30 stores the oil pressure data detected through the oil pressure sensor 22 and engine data such as RPM data detected through an RPM sensor that detects revolutions per minute of the engine in real time, and determines a target oil pressure of the oil gallery 20 based on the engine data.

The electric oil pump controller 40 controls the power supplied to the electric oil pump 10 to control the torque of the electric oil pump 10 and the discharge amount of the engine oil discharged by the electric oil pump 10.

The electric oil pump controller 40 is configured to control the torque of the electric oil pump 10 in accordance with a target oil pressure determined by the electronic control unit 30.

That is, the electronic control unit 30 collects the oil pressure data detected through the oil pressure sensor 22 and engine data such as RPM of the engine in real time to determine a target oil pressure of the oil gallery, and the electric oil pump controller 40 drives the electric oil pump 10 according to the target oil pressure. Accordingly, the electric oil pump 10 may perform a function of controlling the flow rate of the entire engine oil flowing into the oil gallery 20 as described above.

Figure 3:
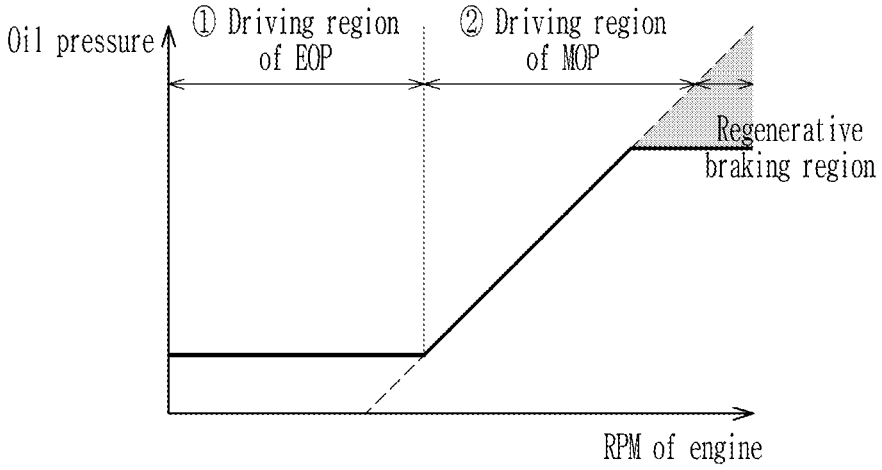
FIG. 3 is a view for explaining a system for controlling a dual oil pump according to one form of the present disclosure.

FIG. 3 is a view for explaining a system for controlling a dual oil pump according to one form of the present disclosure.

Referring to FIG. 2 and FIG. 3, the electronic control unit 30 of the vehicle includes engine data such as oil pressure data detected through the oil pressure sensor 22 and RPM data detected through an RPM sensor that detects revolutions per minute of the engine in real time, it is possible to compare the oil pressure of the oil gallery with a predetermined target oil pressure value.

The mechanical oil pump 14 is connected to the crankshaft of the engine and discharges engine oil from the oil pan of the engine by using a mechanical driving force transmitted according to the driving of the engine.

Due to the characteristics of the mechanical oil pump 14, the discharge pressure of the mechanical oil pump 14 is low in the region where the RPM of the engine is relatively low, in order to satisfy the oil pressure desired to drive the engine, driving of the electric oil pump 10 is desired. On the other hand, in the region where the RPM of the engine is relatively high, the discharge pressure of the mechanical oil pump 14 becomes high, and only the discharge pressure of the mechanical oil pump 14 satisfies the oil pressure desired for driving the engine, or the desired oil pressure will be exceeded.

If the oil pressure detected through the oil pressure sensor 22 is smaller than the target oil pressure determined by the electronic control unit 30, the electric oil pump controller 40 controls to increase the torque of the electric oil pump 10 so that the discharge pressure of the electric oil pump 10 is increased.

The electric oil pump controller 40 generates a stop torque in the electric oil pump 10 when the detected oil pressure is equal to the target oil pressure, and the electric oil pump controller 40 controls the electric oil pump 10 to rotate forward to discharge engine oil from the oil pan, or alternatively, the electric oil pump controller 40 controls the electric oil pump 10 not to reverse by rotating the engine oil back from the mechanical oil pump outlet 16 to the electric oil pump 10. The stop torque may be variably controlled according to the discharge pressure of the mechanical oil pump 14 or the variation of the detected oil pressure.

The electric oil pump controller 40 reduces or dissipates the torque of the electric oil pump 10 when the detected oil pressure is greater than the target oil pressure, and as a result, the engine oil is introduced from the mechanical oil pump outlet end 16 to the electric oil pump outlet 12 by the pressure difference generated, thereby controlling the electric oil pump 10 to rotate in a reverse direction. At this time, regenerative braking occurs in the electric oil pump 10 to generate power, and the generated power is transferred to the battery of the vehicle to charge the battery.

When the detected RPM is less than the first set RPM, the electronic control unit 30 determines the electric oil pump driving region and determines the target oil pressure as the first set oil pressure. That is, in the electric oil pump driving region, the target oil pressure is maintained at a constant value, and the electric oil pump 10 is controlled to satisfy the target oil pressure.

When there is little discharge pressure of the mechanical oil pump 14 because the RPM of the engine is low, the electric oil pump 10 is driven at a high torque to discharge the engine oil at a discharge pressure close to the target oil pressure value. When the RPM of the engine increases to increase the discharge pressure of the mechanical oil pump 14, accordingly, the torque of the electric oil pump 10 is lowered, and as a result, the oil pressure of the engine oil flowing into the oil gallery 20 is maintained at a constant value.

The first set RPM and the first set oil pressure may be set to values determined by a person skilled in the art desirable for supplying engine oil to each part of the engine through the control of an electric oil pump in a region where the engine RPM is relatively low. For example, the first set RPM may be 2500 RPM, and the first set oil pressure may be 1 bar.

The electronic control unit 30 determines to be mechanical oil pump driving region and determines the target oil pressure to be in proportion to the detected RPM when the detected RPM is greater than or equal to the first set RPM and less than the second set RPM value. That is, in the mechanical oil pump driving region, the target oil pressure increases proportionally as the RPM of the engine increases, and the electric oil pump 10 is controlled to satisfy the target oil pressure.

As the RPM of the engine increases, the oil pressure of the engine oil desired for driving the engine increases, while the discharge pressure of the mechanical oil pump 14 that receives the driving force from the engine also increases. Accordingly, the target oil pressure is determined to increase in proportion to the detected RPM.

The second set RPM and the second set oil press may be set to values determined by a person skilled in the art desirable for supplying engine oil to each part of the engine through driving a mechanical oil pump and an electric oil pump in a region where the engine RPM increases. For example, the second set RPM may be 3500 RPM, and the first set oil pressure may be 4 bar.

The electronic control unit 30 determines to be regenerative braking region and determines the target oil pressure to be the second set oil pressure when the detected RPM is greater than or equal to the second set RPM. That is, in the regenerative braking region, the target oil pressure is maintained at a constant value, and the electric oil pump 10 is controlled to satisfy the target oil pressure.

When the RPM of the engine increases and the discharge pressure of the mechanical oil pump exceeds a certain level, the oil pressure of the oil gallery desired for driving the engine is exceeded.

In an exemplary form of the present disclosure as described above, the engine oil discharged at such an excessive discharge pressure flows back to the electric oil pump 10 via the electric oil pump outlet end 12, so that unnecessary engine oil is supplied to the oil gallery 20 unnecessarily. And it is possible to improve the fuel efficiency of the vehicle by charging the battery through the regenerative braking in the electric oil pump 10.

As described above, according to an exemplary form of the present disclosure, in the dual oil pump structure in which the mechanical oil pump and the electric oil pump are provided at the same time, the separate parts such as check valves provided at the outlet of the electric oil pump of the prior art may be deleted, and thus regenerative braking energy may be generated in the electric oil pump using oil supercharged in the electric oil pump. Through this, it is possible to simplify the engine structure, reduce engine driving loss and friction loss, and improve fuel efficiency.

Figure 4:
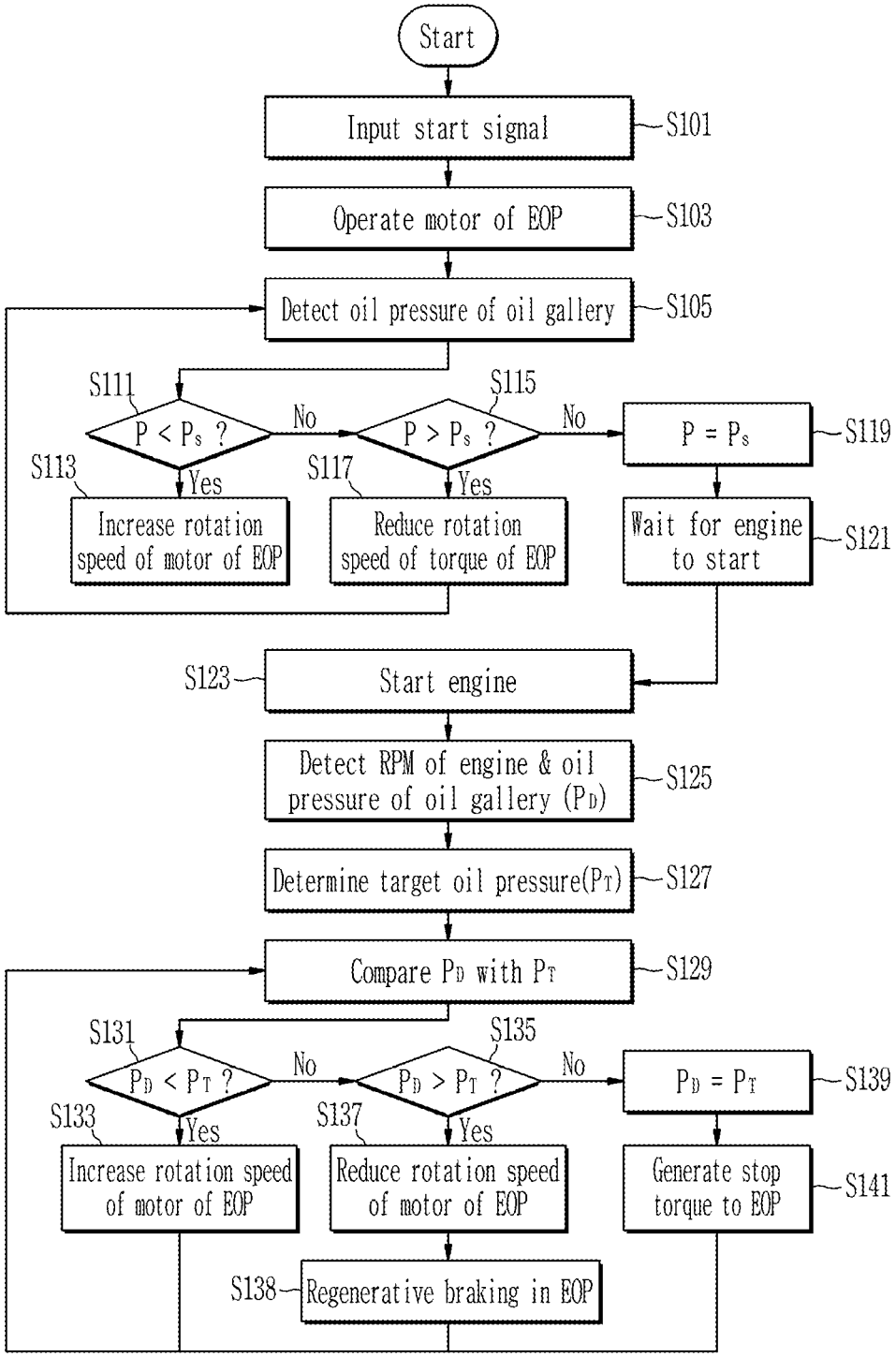
FIG. 4 is a flow chart for explaining a method for controlling a dual oil pump according to another form of the present disclosure.

FIG. 4 is a flow chart for explaining a method for controlling a dual oil pump according to one form of the present disclosure.

Referring to FIG. 2 to FIG. 4, method for controlling dual oil pump according to an exemplary form of the present disclosure starts according to the start signal input of the vehicle S101.

When the start signal of the vehicle is input S101, the controller operates the motor of the electric oil pump 10 S103. When the start signal of the vehicle is input S101, the controller operates the motor of the electric oil pump 10.

The controller detects the oil pressure before start of the oil gallery 20 through the oil pressure sensor 22 S105.

If the oil pressure before the start is less than a predetermined starting target oil pressure $P_S$ value S111, the controller increases the rotation speed and torque of the electric oil pump 10 S113 to increase the oil pressure of the oil gallery 20.

If the oil pressure before the start is greater than the starting target oil pressure S115, the controller reduces the torque of the electric oil pump 10 S117 to reduce the oil pressure of the oil gallery 20.

If the oil pressure before the start is equal to the starting target oil pressure S119, the controller determines that the oil pressure of the oil gallery 20 is appropriate to start the engine S121.

The starting target oil pressure value can be set to a value determined by a person skilled in the art as desirable in starting the engine. For example, the starting target oil pressure may be 1 bar.

When the engine starts S123, the mechanical oil pump 14 connected to the crankshaft of the engine receives the driving force from the engine and starts to discharge the engine oil, thereby increasing the oil pressure of the oil gallery 20.

The controller detects the oil pressure of the oil gallery 20 through the oil pressure sensor 22 in real time, and detects the RPM of the engine in real time through an RPM sensor that detects revolutions per minute of the engine S125. The controller may further detect engine data determined to be desired for the control of the electric oil pump 10.

The controller determines a target oil pressure of the engine based on the detected engine data S127.

When the detected RPM is less than the first set RPM, the controller determines the electric oil pump driving region and determines the target oil pressure as the first set oil pressure. Meanwhile, the controller determines to be mechanical oil pump driving region and determines the target oil pressure to be in proportion to the detected RPM when the detected RPM is greater than or equal to the first set RPM and less than the second set RPM value. Meanwhile, the controller determines to be regenerative braking region and determines the target oil pressure to be the second set oil pressure when the detected RPM is greater than or equal to the second set RPM. Here, the first and second set RPM and the first and second set oil pressure may be set to a value determined by a person skilled in the art preferable for driving the electric oil pump 10 in one form of the present disclosure. Which may be the same as described in FIG. 3. For example, the first and second set RPM may be 2500 RPM and 3500 RPM, and the first set oil pressure and the second set oil pressure may be 1 bar and 4 bar.

The controller compares the detected oil pressure with the target oil pressure S129.

If the detected oil pressure is less than a predetermined target oil pressure value S131, the controller increases the torque of the electric oil pump 10 S133 to increase the oil pressure of the oil gallery 20.

The controller reduces or dissipates the torque of the electric oil pump 10 S137 when the detected oil pressure is greater than the target oil pressure S135, and controls the electric oil pump 10 to reversely rotate by allowing the engine oil to flow from the mechanical oil pump outlet 16 to the electric oil pump outlet 12 by the pressure difference generated thereby. At this time, regenerative braking occurs in the electric oil pump 10 to generate power, and the generated power is transferred to the battery of the vehicle to charge the battery S138.

The controller generates a stop torque to the electric oil pump 10 S141 when the detected oil pressure is equal to the target oil pressure S139, and controls the electric oil pump 10 not to rotate by rotating the electric oil pump 10 forward to discharge the engine oil stored in the oil pan or by flowing the engine oil back from the mechanical oil pump outlet 16 to the electric oil pump 10. The stop torque may be variably controlled according to the discharge pressure of the mechanical oil pump 14 or the variation of the detected oil pressure.

Figure 5A:
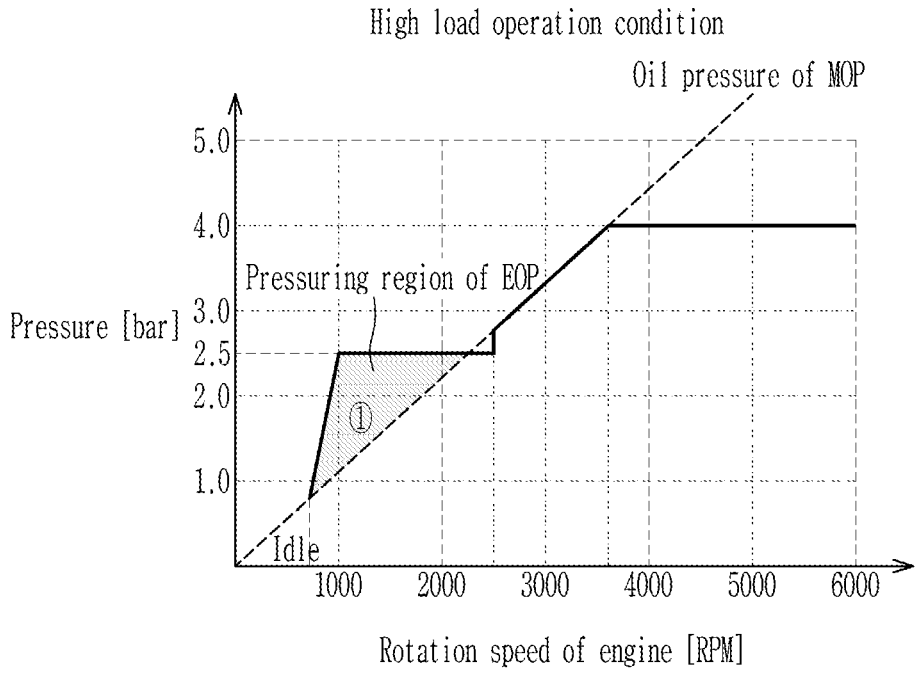
FIG. 5A and FIG. 5B are diagrams for describing system for controlling a dual oil pump according to one form of the present disclosure.
Figure 5B:
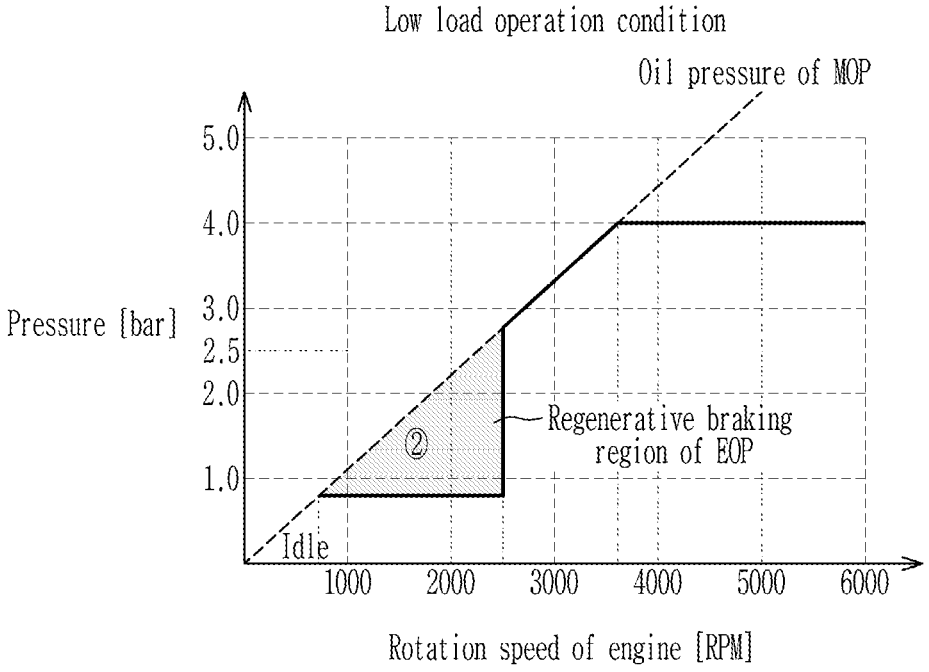

FIG. 5A and FIG. 5B are diagrams for describing system for controlling a dual oil pump according to one form of the present disclosure.

Referring to FIG. 5A, during high load operation of the engine, the oil pressure of the oil gallery 20 desired in the ① region may exceed the oil pressure value generated in the mechanical oil pump as described above with reference to FIGS. 3 and 4. In this case, the controller increases the torque of the electric oil pump 10 in the forward direction so that the oil pressure of the oil gallery 20 increases.

Referring to FIG. 5B, during low load operation of the engine, the oil pressure of the oil gallery 20 desired in the ② region may be less than the oil pressure value generated in the mechanical oil pump as described above with reference to FIGS. 3 and 4. In this case, the controller reduces or dissipates the torque of the electric oil pump 10 when the detected oil pressure is greater than the target oil pressure S135, and controls the electric oil pump 10 to reversely rotate by allowing the engine oil to flow from the mechanical oil pump outlet 16 to the electric oil pump outlet 12 by the pressure difference generated thereby. At this time, regenerative braking occurs in the electric oil pump 10 to generate power, and the generated power is transferred to the battery of the vehicle to charge the battery.

As described above, in an exemplary form of the present disclosure, as the engine is driven at a high load or a low load, the oil pressure value of the oil gallery desired for driving the engine is determined in real time, and the driving of the electric oil pump satisfies the desired oil pressure value, thereby improving the driving efficiency of the engine.

While this present disclosure has been described in connection with what is presently considered to be practical exemplary forms, it is to be understood that the present disclosure is not limited to the disclosed forms, but, on the contrary, is intended to cover various modifications and equivalent arrangements included within the spirit and scope of the appended claims.

<Description of symbols>

| | |
|---|---|
| 10: electric oil pump | 12: electric oil pump outlet |
| 14: mechanical oil pump | 16: mechanical oil pump outlet |
| 18: transmission passage | 20: oil gallery |
| 22: oil pressure sensor | 30: ECU |
| 40: electric oil pump controller | |

What is claimed is:

1. A system for controlling a dual oil pump of an engine, comprising:

an oil pan to store engine oil;

a battery;

an electric oil pump configured to discharge the engine oil from the oil pan using a motor driven with electric power supplied from the battery;

a mechanical oil pump connected to a crankshaft of the engine and configured to discharge the engine oil from the oil pan using a mechanical driving force of the engine;

an oil gallery for circulating the engine oil discharged by the electric oil pump and the mechanical oil pump to each part of the engine;

a transmission passage configured to deliver the engine oil discharged from the electric oil pump and the mechanical oil pump to the oil gallery, and including: an electric oil pump outlet connected to the electric oil pump and a mechanical oil pump outlet connected to the mechanical oil pump;

a data detector configured to detect engine data to control the electric oil pump; and a controller configured to control operation of the electric oil pump, wherein:

the data detector includes an oil pressure sensor configured to detect an oil pressure of the oil gallery, and an RPM sensor configured to detect revolutions per minute (RPM) of the engine, the electric oil pump outlet and the mechanical oil pump outlet of the transmission passage are directly connected to each other, and the controller is configured to:

determine a target oil pressure of the oil gallery based on the engine data detected through the data detector, and rotate the electric oil pump either in a forward direction or in a reverse direction, or stop based on the target oil pressure.

2. The system for controlling the dual oil pump of claim 1, wherein the controller is configured to control a rotation speed and increase a torque of the electric oil pump when the detected oil pressure is less than the target oil pressure.

3. The system for controlling the dual oil pump of claim 1, wherein the controller is configured to:

generate a stop torque to the electric oil pump when the detected oil pressure is equal to the target oil pressure, and control the electric oil pump to stop rotating by discharging the engine oil of the oil pan or by flowing the engine oil back from the mechanical oil pump outlet to the electric oil pump.

4. The system for controlling the dual oil pump of claim 1, wherein the controller is configured to:

reduce or dissipate a torque of the electric oil pump when the detected oil pressure is greater than the target oil pressure, and control the electric oil pump to rotate in the reverse direction by allowing the engine oil to flow from the mechanical oil pump outlet to the electric oil pump outlet by a pressure difference generated thereby.

5. The system for controlling the dual oil pump of claim 4, wherein:

the battery is charged by transferring power generated by the reverse rotation of the electric oil pump to the battery.

6. The system for controlling the dual oil pump of claim 1, wherein:

the controller is configured to:

determine an electric oil pump driving region when the detected RPM is smaller than a first set RPM and determine the target oil pressure to be a first set oil pressure, determine a mechanical oil pump driving region when the detected RPM is greater than or equal to the first set RPM and less than a second set RPM value and determine the target oil pressure to be in proportion to the detected RPM, and determine a regenerative braking region when the detected RPM is greater than or equal to the second set RPM and determine the target oil pressure to be a second set oil pressure.

7. The system for controlling the dual oil pump of claim 1, wherein:

the controller includes:

an electric oil pump controller configured to control the power supplied to the electric oil pump to control a torque of the electric oil pump and a discharge amount of the engine oil discharged by the electric oil pump; and an electronic control unit configured to control the electric oil pump controller.

8. A method for controlling a dual oil pump of a system, where the system includes: the dual oil pump having an electric oil pump and a mechanical oil pump, an oil gallery, a transmission passage for delivering engine oil discharged from the electric oil pump and the mechanical oil pump to the oil gallery and including an electric oil pump outlet connected to the electric oil pump and a mechanical oil pump outlet connected to the mechanical oil pump, a data detector for detecting engine data including at least an oil pressure or revolutions per minute (RPM) of an engine, and a controller for controlling operation of the electric oil pump by controlling power supplied to the electric oil pump, the method comprising:

driving the electric oil pump by the controller;

detecting the engine data by the data detector;

determining, by the controller, a target oil pressure based on the detected engine data;

comparing, by the controller, the detected oil pressure with the target oil pressure; and controlling, by the controller, a torque of the electric oil pump such that the electric oil pump rotates either in a forward direction or in a reverse direction, or stops based on a comparison result of the target oil pressure and the detected oil pressure.

9. The method for controlling dual oil pump of claim 8, wherein:

in controlling the torque of the electric oil pump, the torque of the electric oil pump is controlled to increase when the detected oil pressure is less than the target oil pressure.

10. The method for controlling dual oil pump of claim 8, wherein:

in controlling the torque of the electric oil pump, a stop torque to the electric oil pump is generated when the detected oil pressure is equal to the target oil pressure, and the electric oil pump is controlled not to rotate by rotating the electric oil pump in the forward direction to discharge the engine oil of an oil pan or by flowing the engine oil back from the mechanical oil pump outlet to the electric oil pump.

11. The method for controlling dual oil pump of claim 8, wherein:

in controlling the torque of the electric oil pump, the torque of the electric oil pump is reduced or dissipated when the detected oil pressure is greater than the target oil pressure, and the electric oil pump is controlled to rotate in the reverse direction by allowing the engine oil to flow from the mechanical oil pump outlet to the electric oil pump outlet by a pressure difference generated thereby.

12. The method for controlling dual oil pump of claim 11, wherein:

controlling the torque of the electric oil pump includes:

charging a battery by transferring power generated by the reverse rotation of the electric oil pump to the battery.

13. The method for controlling dual oil pump of claim 8, wherein:

in determining a target oil pressure, when the detected RPM is smaller than a first set RPM, the target oil pressure is determined to be a first set oil pressure for an electric oil pump driving region, when the detected RPM is greater than or equal to the first set RPM and less than a second set RPM value, the target oil pressure is determined to be in proportion to the detected RPM for a mechanical oil pump driving region, and when the detected RPM is greater than or equal to the second set RPM, the target oil pressure is determined to be a second set oil pressure for a regenerative braking region.

* * * * *